US005827090A

United States Patent [19]

Knighton

[11] Patent Number: 5,827,090

[45] Date of Patent: Oct. 27, 1998

[54] SIDE MOUNT STRAIN RELIEF FOR PCMCIA CONNECTOR

[75] Inventor: David B. Knighton, Longmont, Colo.

[73] Assignee: Maxtor Corporation, Longmont, Colo.

[21] Appl. No.: 609,088

[22] Filed: Feb. 29, 1996

Related U.S. Application Data

[63] Continuation of Ser. No. 279,633, Jul. 22, 1994, abandoned.

[51] Int. Cl.[6] ..... H01R 13/74

[52] U.S. Cl. ..... 439/571

[58] Field of Search ..... 439/59, 60, 62, 439/449, 452, 460, 569, 571–573, 79, 374

[56] References Cited

U.S. PATENT DOCUMENTS

| | | | |
|---|---|---|---|
| 4,708,415 | 11/1987 | White | 439/59 |
| 4,717,218 | 1/1988 | Ratcliff | 439/59 |
| 5,037,309 | 8/1991 | Abe et al. | 439/59 |
| 5,241,134 | 8/1993 | Yoo | 439/876 |
| 5,313,364 | 5/1994 | Omori et al. | 439/76.1 |
| 5,316,489 | 5/1994 | Kachlic et al. | 439/569 |

*Primary Examiner*—Gary F. Paumen
*Attorney, Agent, or Firm*—Sheridan Ross P.C.

[57] ABSTRACT

An electrical connector which can be mounted to a printed circuit board with automated equipment. The connector has a pair of locating pins that extend from a pair of locating tabs at the ends of the connector housing. The connector also has a plurality of solder tails that can be soldered to corresponding surface pads of the printed circuit board. To assemble the connector to a printed circuit board, the locating pins are pressed into corresponding locating holes of the board. The locating pins and holes align the solder tails with the surface pads of the board. The locating pins are located at a position offset from the center of gravity of the connector. The offset locating pins place the center of gravity of the connector closer to the edge of the circuit board so that the weight of the connector does not pull the solder tails away from the surface pads before the solder tails are soldered to the board.

12 Claims, 3 Drawing Sheets

20
15
15
14
22
16
12
10

26
30
28
26
28
30
22
20

10
18
12
14
18
16
16
15
12
15
20

SIDE MOUNT STRAIN RELIEF FOR PCMCIA CONNECTOR

This is a continuation of application Ser. No. 08/279,633 filed Jul. 22, 1994, now abandoned.

BACKGROUND OF THE INVENTION

1. Field of the Invention

The present invention relates to a printed circuit board/electrical connector assembly.

2. Description of Related Art

Electrical components are typically mounted to a printed circuit board that has an electrical connector attached to one edge of the board. The board connector is plugged into a mating connector to electrically couple the board to another device. For example, the assignee of the present application, Maxtor Corp., presently produces a portable card-like hard disk drive that has a connector located at one end of the drive. The portable disk drive can be attached to a host system by plugging the connector into a mating receptacle connector.

The connector of the Maxtor disk drive has 68 sockets that each have a solder tail which is soldered to a corresponding surface pad of a printed circuit board located within the disk drive. When assembling a disk drive unit, the electrical connector is typically soldered to the printed circuit board before the circuit board is mounted to the housing of the drive. The sockets within the connector are relatively heavy and have a tendency to pull the solder tails away from the circuit board before the connector is soldered to the board. To prevent such movement, the connectors are typically held and manually soldered to the printed circuit board. Manual soldering techniques are relatively time consuming and labor intensive, thereby increasing the overall cost of producing the disk drives. It would be desirable to have a connector that can be soldered to a printed circuit board with automated equipment.

SUMMARY OF THE INVENTION

The present invention is an electrical connector which can be mounted to a printed circuit board with automated equipment. The connector has a pair of locating pins that extend from a pair of locating tabs at the ends of the connector housing. The connector also has a plurality of solder tails that can be soldered to corresponding surface pads of the printed circuit board. To assemble the connector to a printed circuit board, the locating pins are pressed into corresponding locating holes of the board. The locating pins and holes align the solder tails with the surface pads of the board. The locating pins are located at a position offset from the center of gravity of the connector. The offset locating pins place the center of gravity of the connector closer to the edge of the circuit board so that the weight of the connector does not pull the solder tails away from the surface pads before the solder tails are soldered to the board. The balanced connector assembly allows the connector to be mounted and soldered to the printed circuit board with automated equipment.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
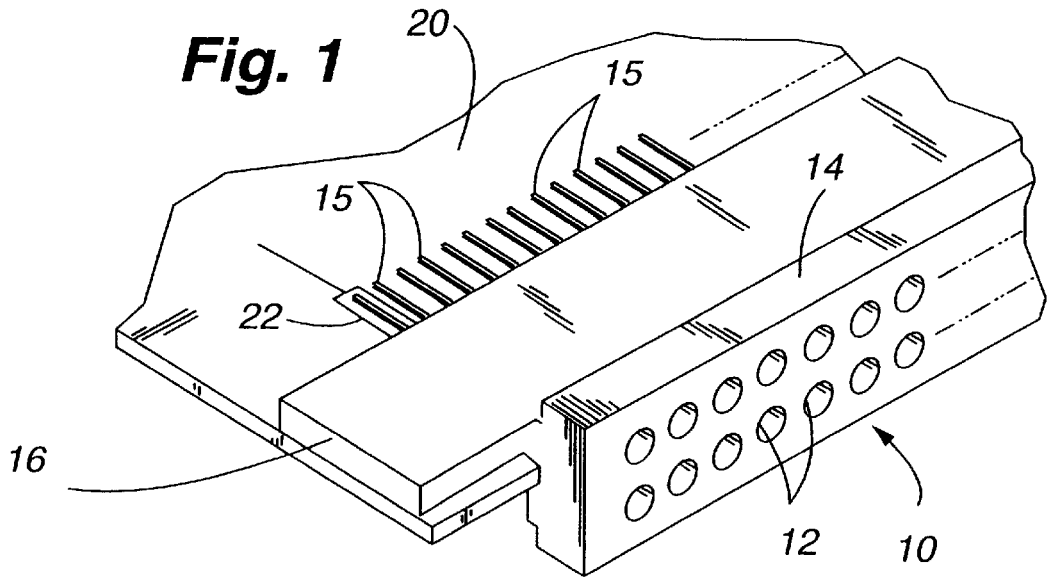
FIG. 1 is a perspective view of a connector of the present invention.

Referring to the drawings more particularly by reference numbers, FIG. 1 shows an electrical connector 10 of the present invention. The electrical connector 10 has a plurality of metal sockets 12 located within a dielectric housing 14. Each socket 12 has a solder tail 15 that extends from the housing 14. The sockets 12 receive mating pins (not shown) of a receptacle connector as is known in the art. Although sockets 12 are shown and described, it is to be understood that the connector 10 may have pins in lieu of the sockets. In the preferred embodiment, the connector 10 has 68 pins which complies with the specifications promulgated by the Personal Computer Memory Card International Association (PCMCIA).

The connector 10 has a pair of locating tabs 16 located at the ends of the housing 14. Extending from the locating tabs 16 are a pair of locating pins 18 (See FIGS. 3*a* and 3*b*). The locating pins 18 are preferably constructed from brass and are pressed into corresponding apertures in the tabs 16. As an alternate embodiment, the pins 18 may be molded with the housing 14. The locating pins 18 are located at a position that is offset from the center of gravity of the connector 10.

Figure 2:
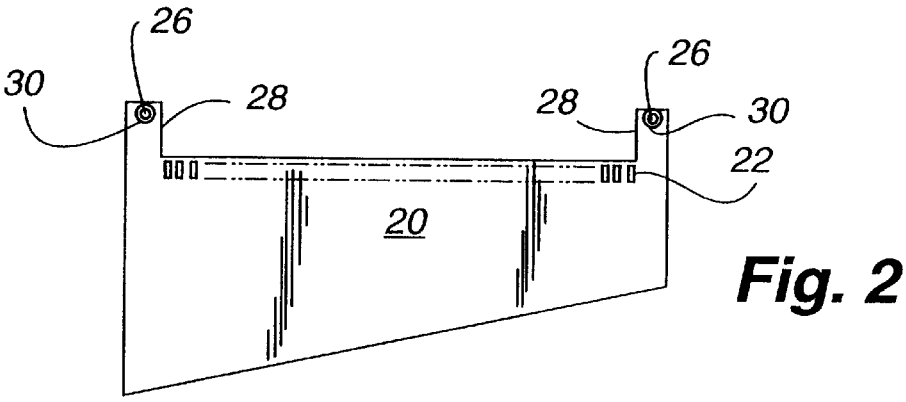
FIG. 2 is a top view of a printed circuit board of the present invention.

The connector 10 is assembled to the printed circuit board 20 shown in FIG. 2. The printed circuit board 20 has a plurality of surface pads 22 located along an edge of the board. The surface pads 22 are coupled to electronic components 24 by conductive board routing (not shown) as is known in the art. The surface pads 22 are soldered to the solder tails 15 of the connector 10. Although surface pads 22 are shown and described, it is to be understood that a circuit board with plated through holes can be used in the present invention.

The circuit board 20 has a pair of locating holes 26 within outer tabs 28 of the board. In the preferred embodiment, the locating holes 26 are plated so that there is a ring of metal 30 on the surface of the board 20. The metal ring 30 may be soldered to the locating pins 18 to increase the structural integrity of the board/connector assembly. The printed circuit board 20 may be double sided, wherein there are electrical components 24 and surface pads 22 on both sides of the board 20.

Figure 3A:
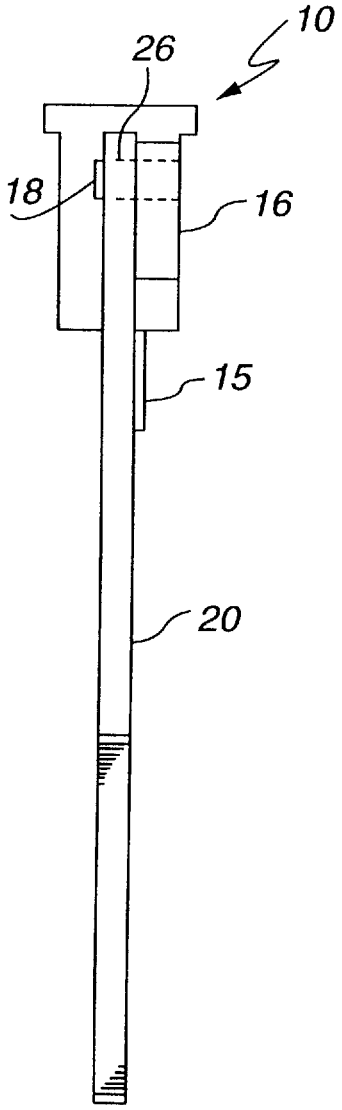
FIG. 3A is a side view showing the connector assembled to the circuit board.
Figure 3B:
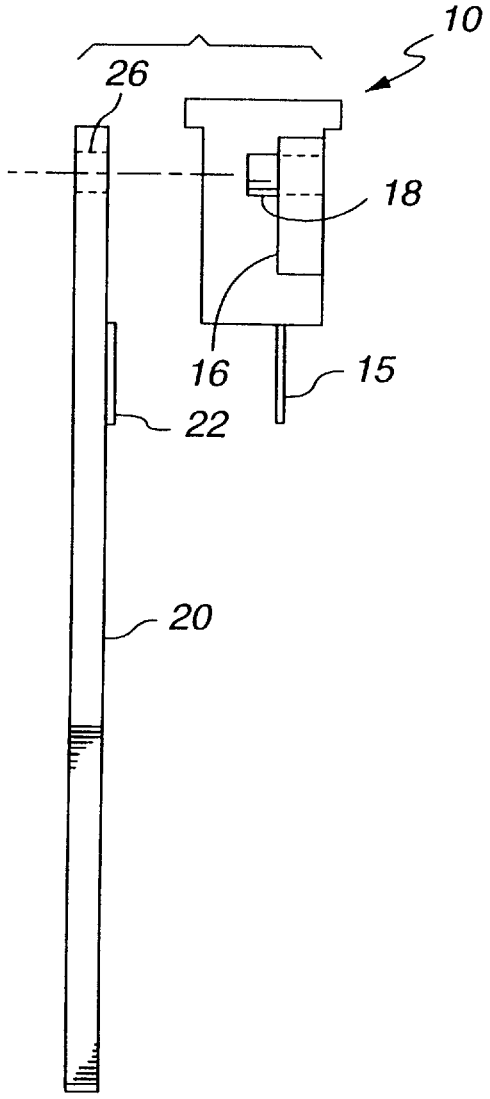
FIG. 3B is a side view showing the connector being mounted to the printed circuit board.

As shown in FIGS. 3A and 3B, to assemble the connector 10 to the circuit board 20, the connector 10 is mounted to the board 20 so that the locating pins 18 can be pressed into the locating holes 26. Pressing the locating pins 18 into the locating holes 26 aligns the solder tails 15 with the surface pads 22. A solder paste is typically applied to the surface pads 22 before the connector 10 is mounted to the board 20. After the connector is mounted, the solder is reflowed to solder the tails 15 to the pads 22. The connector 10 can be mounted to the circuit board 20 by an automated pick and place machine that also mounts the electrical components 24 to the board.

Figure 4:
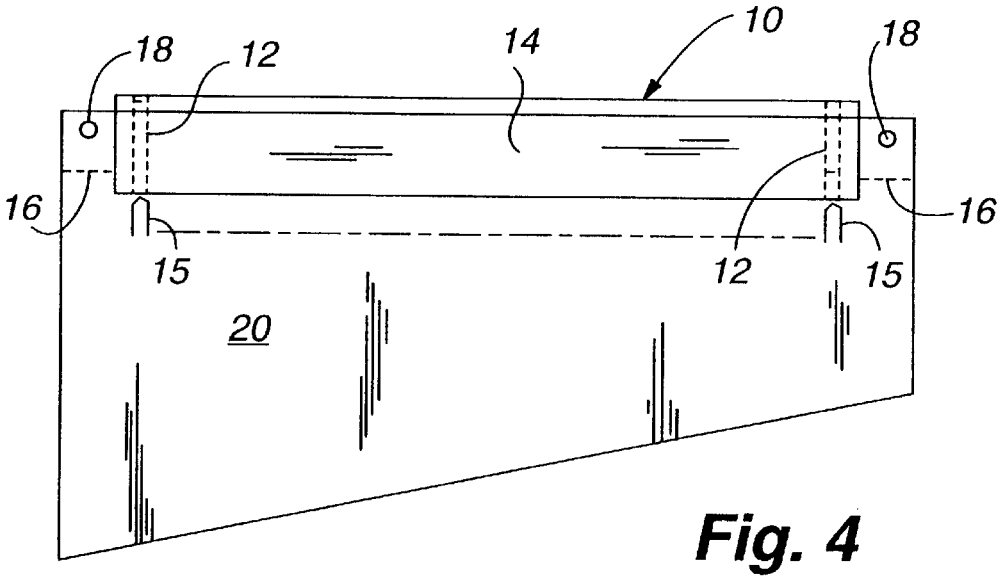
FIG. 4 is a top view showing the connector assembled to the printed circuit board.

As shown in FIG. 4, when the connector 10 is initially mounted to the circuit board, and before the solder is reflowed, the center of gravity of the connector is closer to the edge of the board than the pins 18, wherein any rotation of the connector tends to be toward the board instead of away from the board. Offsetting the pins 18 from the center of gravity maintains the connector 10 in a position so that the solder tails 15 do not become detached from the circuit board 20. Maintaining the position of the connector allows the solder tails 15 to be soldered to the board 20 with conventional automated solder reflow equipment, thereby reducing the assembly time and cost of producing a board assembly.

Figure 5:
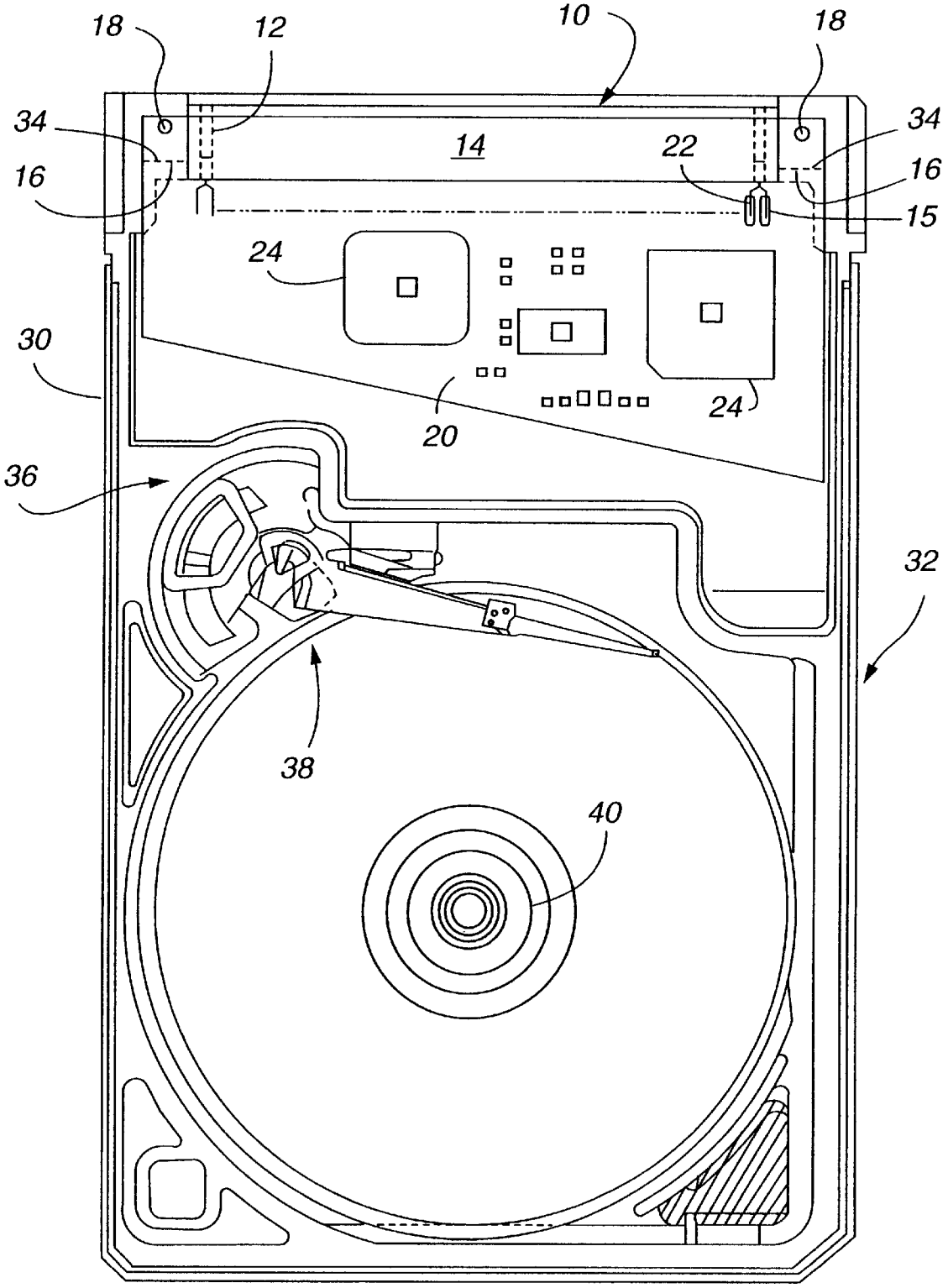
FIG. 5 is a top view showing an assembled circuit board mounted to the cover plate of a hard disk drive.

As shown in FIG. 5, the board 20 and connector 10 can be mounted to the cover plate 30 of a hard disk drive 32. The cover plate 30 may have a pair of locating notches 34 that receive the locating tabs 16 of the connector 10. The notches 34 and tabs 16 align the circuit board 20 and connector 10 within the disk drive 32. Capturing the tabs 16 also provides structural support for the connector when the connector is plugged into and pulled out of a mating connector. Inserting and detaching mating pin connectors requires a certain amount of force. The insertion/detachment force can produce a mechanical strain on the solder tails. The notches 34 of the plate reduce the amount of force transmitted to the solder tails during insertion and detachment of the connector.

The disk drive 32 contains a disk 36 that is rotated relative to an actuator arm assembly 38 by a spin motor 40. The electrical components 24 are coupled to both the spin motor 40 and the actuator 38, and control the operation of the disk drive 32. All of the components of the disk drive are enclosed by the cover plate 30 and a base plate (not shown) which have dimensions that may comply with the specifications of the PCMCIA. The present invention thus provides a low profile circuit board/connector assembly that provides strain relief and can be assembled with conventional automated soldering equipment.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A hard disk drive, comprising:

a housing;

a disk within said housing;

a spin motor that rotates said disk;

an actuator arm assembly operatively coupled to said disk;

a printed circuit board mounted to said housing and containing a surface pad;

an electronic device mounted to said printed circuit board; and an electrical connector that is coupled to said printed circuit board, said electrical connector including:

(a) a body, said body having first and second ends and first and second sides, wherein a center of said body is located midway between said first and second ends, (b) an electrical contact extending from said first end of said body and (c) first and second locating pins, wherein said first and second locating pins are located proximate to said first and second sides, respectively, and each of said locating pins penetrates said board at only a single location in said board, said first and second locating pins being offset towards said second end from said center of said electrical connector body, wherein said electrical contact is biased into contact with said surface pad.

2. The hard disk drive as recited in claim 1, wherein said first and second locating pins are pressed into first and second locating holes, respectively, of said printed circuit board.

3. The hard disk drive as recited in claim 1, wherein said electrical connector includes first and second locating tabs, said first and second locating pins respectively extending from said first and second locating tabs of said electrical connector.

4. The hard disk drive as recited in claim 3, wherein said solder tails extend from a plurality of sockets.

5. A printed circuit board assembly for use in an electronic device contained within a housing, comprising:

a printed circuit board mounted to said housing, said printed circuit board having a plurality of surface pads and first and second locating holes; and, an electrical connector that is coupled to said printed circuit board, said electrical connector including:

(a) a body said body having first and second ends and first and second sides, wherein a center of said body is located midway between said first and second ends, (b) plurality of solder tails extending from said first end and (c) first and second locating pins positioned proximate to said first and second ends, respectively, said first and second locating pins being respectively attached to said printed circuit board solely through first and second locating holes, said first and second locating pins both being offset toward said second end from said center of said electrical connector body, wherein said solder tails are biased into contact with said surface pads.

6. The assembly as recited in claim 5, wherein said first and second locating pins are pressed into said first and second locating holes, respectively, of said printed circuit board.

7. The assembly as recited in claim 5, wherein said electrical connector includes first and second locating tabs, said first and second locating pins respectively extending from said first and second locating tabs of said electrical connector.

8. An electrical connector, comprising;

a housing having a first end, a second end, a first side and a second side, and a center located midway between said first and second ends;

a plurality of sockets within said housing;

a plurality of solder tails that are connected to said sockets and extend from said first end of said housing;

first and second locating tabs that extend from said first and second ends of said housing respectively; and, first and second locating pins that extend from said first and second locating tabs, respectively, said first and second locating pins adapted for connection to a printed circuit board only through first and second locating holes in said printed circuit board, respectively, said locating pins being located at a position offset towards said second end from said center of the electrical connector housing.

9. The hard disk drive of claim 1, wherein said locating pins are rigidly carried by said body of said electrical connector so as to substantially prevent any relative deflection therebetween.

10. The hard disk drive of claim 1, wherein said locating pins are soldered to said printed circuit board.

11. The assembly of claim 5, wherein said locating pins are rigidly carried by said body of said electrical connector so as to substantially prevent any relative deflection therebetween.

12. The assembly of claim 5, wherein aid locating pins are soldered to said printed circuit board.

* * * * *

UNITED STATES PATENT AND TRADEMARK OFFICE

CERTIFICATE OF CORRECTION

PATENT NO. : 5,827,090

DATED : October 27, 1998

INVENTOR(S) : KNIGHTON

It is certified that error appears in the above-identified patent and that said Letters Patent is hereby corrected as shown below:

In Claim 1, Column 4, line 10, please delete "wherein" and insert -- so that --.

In Claim 5, Column 4, line 40, please delete "ends" and insert -- sides --.

In Claim 5, Column 4, line 45, please delete "wherein" and insert -- so that --.

In Claim 8, Column 4, line 59, please delete "housing" and insert -- body --.

In Claim 8, Column 4, line 62, please delete "housing" and insert -- body --.

In Claim 8, Column 4, line 64, please delete "housing" and insert -- body --.

UNITED STATES PATENT AND TRADEMARK OFFICE

CERTIFICATE OF CORRECTION

PATENT NO. : 5,827,090
DATED : October 27,1998
INVENTOR(S) : Knighton

It is certified that error appears in the above-identified patent and that said Letters Patent is hereby corrected as shown below:

In Claim 8, Column 4, line 66, please delete "ends" and insert -- sides --, and delete "housing" and insert -- body --.

In Claim 8, Column 5, line 8, please delete "housing" and insert -- body --, and insert -- so that said solder tails are biased into contact with the circuit board -- before the period.

Signed and Sealed this

Twenty-fifth Day of May, 1999

*Attest:*

Q. TODD DICKINSON

*Attesting Officer*

*Acting Commissioner of Patents and Trademarks*